US005372255A

United States Patent [19]

Skorski et al.

[11] Patent Number: 5,372,255

[45] Date of Patent: Dec. 13, 1994

[54] PACKING SHROUD

[75] Inventors: Mark J. Skorski, Reisterstown; James H. Rogers, Sparks, both of Md.

[73] Assignee: Lever Brothers Company, Division of Conopco, Inc., New York, N.Y.

[21] Appl. No.: 175,018

[22] Filed: Dec. 29, 1993

[51] Int. Cl.[5] ..... B65D 19/00; B65D 5/42

[52] U.S. Cl. ..... 206/386; 206/586

[58] Field of Search ..... 206/586, 386

[56] References Cited

U.S. PATENT DOCUMENTS

| | | | |
|---|---|---|---|
| 3,100,468 | 8/1963 | Wetmore et al. | 206/386 |
| 3,394,862 | 7/1968 | Greene et al. . | |
| 4,019,634 | 4/1977 | Bonnot | 206/386 |
| 4,383,609 | 5/1983 | Lochmiller | 206/386 |
| 4,567,981 | 2/1986 | Headon . | |
| 4,799,593 | 1/1989 | Lawrence | 206/586 |
| 4,919,270 | 4/1990 | Govang et al. . | |
| 5,105,946 | 4/1992 | McDowell | 206/386 |

*Primary Examiner*—William I. Price

*Attorney, Agent, or Firm*—Gerard J. McGowan, Jr.

[57] ABSTRACT

A one piece shroud combined with a stack and preferably a pallet. The shroud includes first and second central panels, first and third lateral panels on either side of the first central panel and second and fourth lateral panels on either side of the second central panel.

21 Claims, 2 Drawing Sheets

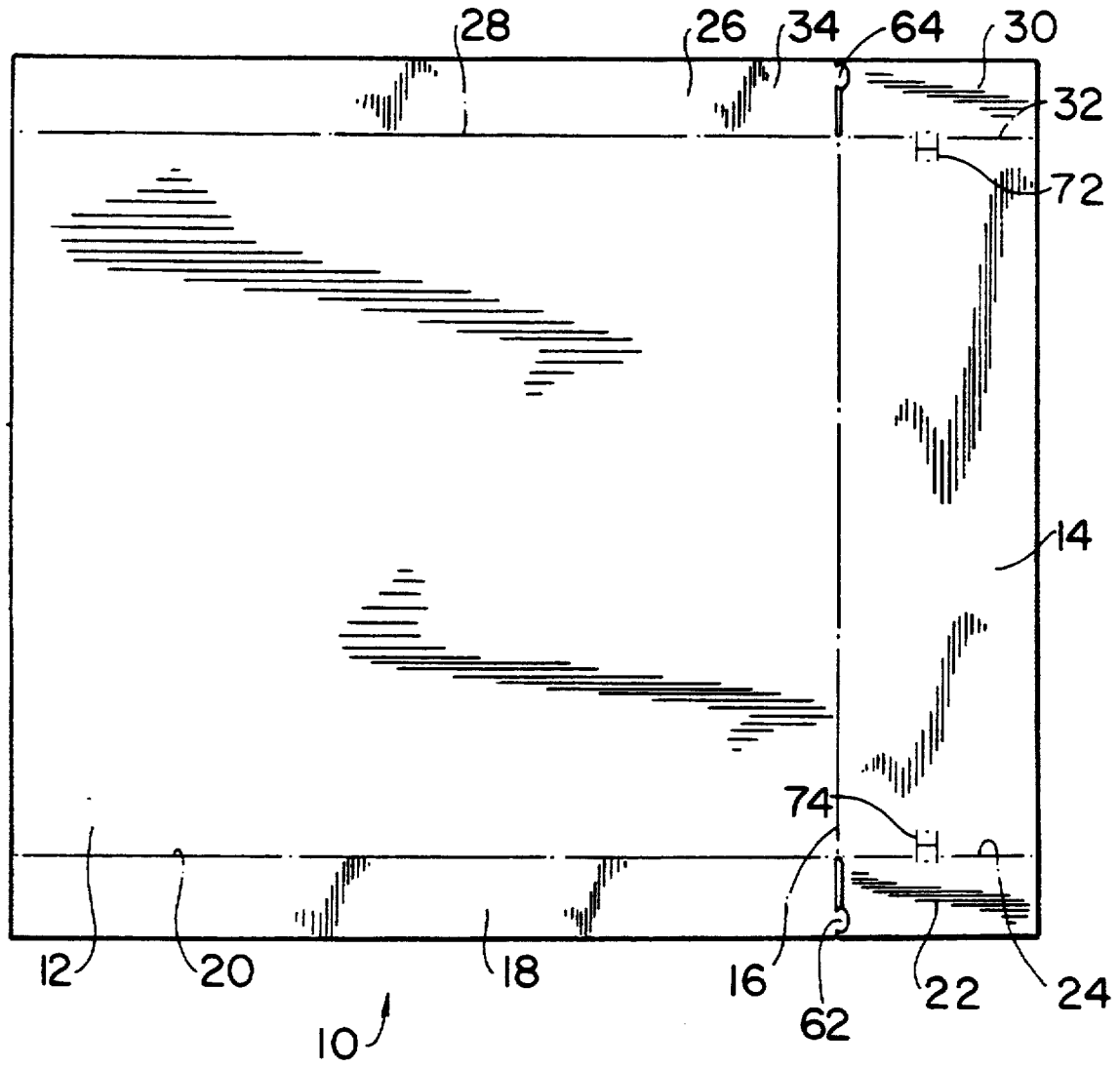
28
26
34
64
30
32
72
14
74
12
20
18
16
62
22
24
10

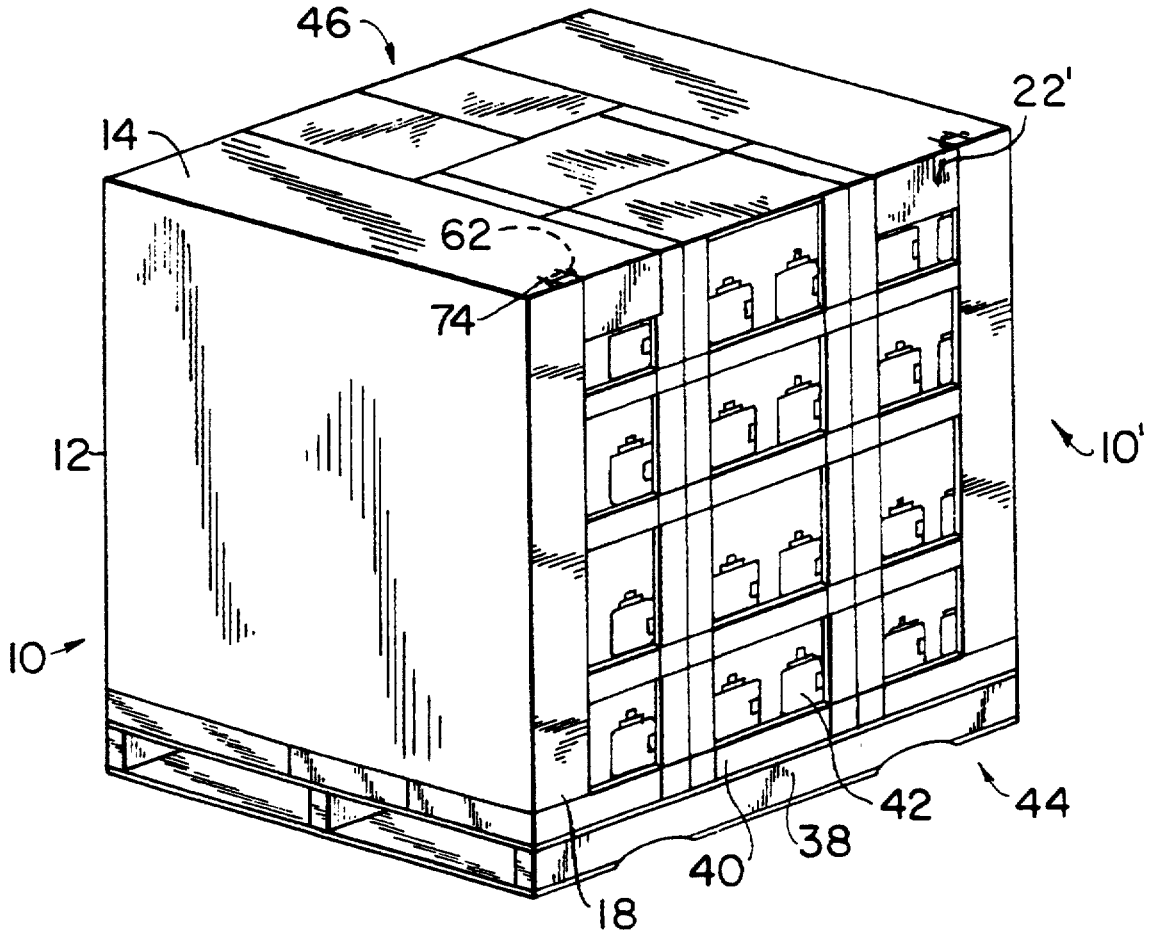
46
22'
14
62
74
12
10'
10
42
44
38
40
18

PACKING SHROUD

BACKGROUND OF THE INVENTION

Consumer products such as heavy duty liquid laundry detergent bottles are typically shipped in cases having multiple bottles per case. For example, a case of eight such bottles may be used. The case is typically made of corrugated paperboard. Within the manufacturing facility, the distribution warehouse, or other intermediate or final destinations, the cases are typically transported by stacking them onto a flat platform called a pallet and moving the pallet means of a forklift.

It is, of course, desirable that the cases not topple over while on the pallet, whether during transport on the forklift or when remaining stationary. One means of preventing such an event which has been employed includes the use of two three-piece structures, one at each side of the stack. The three pieces comprise two corrugated corner posts and a connecting piece of corrugated paperboard. When this arrangement is used, a corner post is present at each corner and the paperboard is present between the cornerposts on each side of the stack along the edge of the stack between the top of the stack and the side of the stack.

The three-piece items are awkward to use in that they require gluing the corner posts to the paperboard and result in an ungainly structure which has two long legs (the posts) connected by a relatively narrow intermediate piece.

McDowell U.S. Pat. No. 5,105,946 discloses a container for shipping sheets of glass or other fragile material. A front portion 16 including two end walls 17 and 18, a top panel 20 and end extension panels 22 and 23 is illustrated in FIG. 2.

Govang et al. U.S. Pat. No. 4,919,270 discloses a pallet assembly for promotional display. In FIG. 8 a blank is disclosed having a rectangular panel 30 and end and side flaps 32 and 34. Also, end tabs 36 are disclosed.

Lawrence U.S. Pat. No. 4,799,593 discloses skeleton packs where the packs are grouped in pallet loads and have a rear member to take vertical load. FIGS. 4, 5 and 6 illustrate a support member having a base panel 3 and a vertical panel 4 and having flanges 5 on the vertical panel and 8 on the base panel.

Headon U.S. Pat. No. 4,567,981 discloses a stack display system including an enclosure 46 which wraps around layers of bottles and other packaging.

Lochmiller U.S. Pat. No. 4,383,609 discloses a pallet, end locking sections 17 and side locking members 20.

Bonnot U.S. Pat. No. 4,019,634 discloses a collapsible shipping container including a pair of U-shaped panels 42 and 44.

Greene et al. U.S. Pat. No. 3,394,862 discloses end panels 24 in FIGS. 5 and 6.

Wetmore et al. U.S. Pat. No. 3,100,046 discloses in FIG. 3 a sheet which may be folded to provide one half of a protective covering.

SUMMARY OF THE INVENTION

The invention employs a one piece shroud which may be used to secure stacks of cases, particularly stacks of cases on pallets. In particular, the present invention is directed to a combination of pallet, stacked cases and a one piece shroud. The shroud serves to protect the integrity of the stack while on the pallet both during storage and transport. Preferably, two shrouds, one at each side of the stack, are used. If desired, all or part of the pallet/shroud/stack combination may be wrapped in a plastic film.

Each shroud is comprised of a single piece, divided into several panels by hinge lines, which may be scorelines. The shroud is preferably fabricated from corrugated fiberboard. Typically, the shroud includes a first central panel and a second central panel separated from the first by a hinge line. The first central panel will abut a side face of the stack whereas the second central panel will lie adjacent to the top face of the stack. Lateral panels, each of which is separated from a central panels by a hinge line will extend along a portion of the top edge, and of at least one side edge, of the front and rear faces of the stack.

In a preferred embodiment, separated by a hinge line from the first central panel is a first lateral panel, the inner surface of which will face the front or back face of the stack. According to this embodiment, depending from the second central panel is a second lateral panel, the inner face of which will also face the front or back face of the stack. Relative to the stack, the second lateral panel is disposed medially to the first lateral panel when the shroud is in place on the stack. Preferably, two shrouds are employed, each covering one of the two side faces of the stack and each of which includes in addition to the two central panels two first lateral panels and two second lateral panels, one on each side of the shroud.

For a more complete understanding of the above and other features and advantages of the invention, reference should be made to the following detailed description of preferred embodiments and to the accompanying drawings.

BRIEF DESCRIPTION OF THE DRAWINGS

FIG. 1 is a top plan view of a blank used in preparation of the shroud of the invention.

FIG. 2 is a perspective view of a combination pallet, stack of cases and shroud in accordance with the invention.

DETAILED DESCRIPTION OF THE INVENTION

As seen in FIG. 1, shroud 10 comprises first central panel 12 and second central panel 14 separated from central panel 12 by scoreline 16. Scoreline 16 or any of the other scorelines disclosed herein may be any line suitable for producing a hinge (i.e., a hingeline), such as a scoreline without cuts, a perforated line (intermittent cuts), a partially cut line (e.g., a line formed by cutting partially but not completely through the fiberboard), etc.

On one side of central panel 12, disposed perpendicularly to scoreline 16, is first lateral panel 18, separated from panel 12 by scoreline 20. On the same side of the shroud as first lateral panel 18 is second lateral panel 22 separated from second central panel 14 by scoreline 24. Scorelines 20 and 24 are substantially colinear and may be impressed together during the same scoring or other hingeline-forming operation, or may be formed separately. On the side of first central panel 12 opposite that of scoreline 20 is third lateral panel 26 separated from panel 12 by scoreline 28. On the side opposite second central panel 14 from scoreline 24 is fourth lateral panel 30 separated from panel 14 by scoreline 32. Scoreline 28 and 32, like scorelines 18 and 22 are substantially colinear and can be formed from a single line during one scoring operation or may be formed from separate lines.

Each of the panels within panel pairs 18, 22 and 26, 30 can rotate along its respective hingeline independently of the other panel in the pair in that either the panels are not attached or, alternatively, they are attached only by easily tearable portions 62, 64 having the small perforated sections shown.

As seen in FIG. 1, the scorelines include perforated sections 34 to assist in the folding thereof. Offset from scorelines 24 and 32, which separate panels 22 and 30 from panel 14, are "H" cuts 72 and 74. The "H" cuts include scores parallel to scorelines 24 and 32 connecting the legs of the "H" at the top and the bottom. Tabs 62 and 64 are separated from panels 18 and 26 by small scorelines and are partially formed by cuts within panels 22 and 30. As will be discussed below, tabs 62 and 64 are inserted into "H" cuts 72 and 74 to lock the shroud into place during assembly.

The shroud is fabricated from corrugated fiberboard such as a 200–275 lb. Mullens Test board. A 69/33/69 board available from Westvaco would be suitable.

As seen in FIG. 2, pallet 38 has stacked thereon cases 40 which contain liquid laundry detergent bottles 42. The cases are preferably stacked so that the stack includes a front face 44 seen in FIG. 2, a first side face on the side thereof, a back face opposite face 44 and a second side face between face 44 and the back face. A top face 46 is also formed by the stack. Preferably, each of the faces formed by the outer aspects of the cartons forms a straight wall (vertically in the case of the front, back and side faces).

The shroud is formed from the blank by bending 90° along scoreline 16, scoreline 20, scoreline 28, scoreline 32 and scoreline 24. Typically, the second and forth lateral panels 22 and 30 will, after the blank is folded, fit partially behind the first and third lateral panels and tabs 62 and 64 inserted and locked into "H" cuts 72 and 74 offset from scores 24 and 32 to hold the shroud in its final form.

A shroud is placed on each side face of the stack so that the first central panel is adjacent to and faces the side stack face and the second central panel is disposed adjacent and faces the top face of the stack. Preferably, the inner surfaces of each of the panels of the shroud are substantially contiguous with a portion of a face of the stack. If desired, plastic film such as Mobil Stretch Wrap may be wrapped around the front, back and sides of the pallet/stack/shroud combination to maintain its integrity during storage or particularly during shipping. The shroud serves to keep the stack aligned. The shrouds are made of durable corrugated fiberboard and eliminate the need for multi-piece items such as corner post/shroud combinations. The one piece aspect of the shroud facilitates its installation onto the palletized stack. No adhesives are required to hold the shroud in final form; instead, self-locking corrugated tabs are employed. The shroud may be shipped flat and erected at time of use. The shroud also can be used on cases for other types of products, such as powdered detergents and soap bars with dimensional changes. The shroud of the invention is less expensive and requires less resource than many alternatives.

Typically, the central panel will cover at least 50% of the surface area of the stack side face, preferably at least 80%. Each second central panel will generally cover between 10 and 40% of the area of the top stack face, especially between 15 and 30%. The first and third lateral panels, respectively, of each shroud will generally cover between 5 and 10% of the area of the front and/or back faces of the stack. Each of the second and/or fourth lateral panel will typically cover between 1 and 7% of the area of the front and/or back stack face.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A combined shroud and stack of cases comprising:
   a) a plurality of cases forming a stack having a side face, a top face and front and rear faces on opposite sides of said side face,
   b) a one piece shroud having a first central panel adjacent said stack side face, a second central panel separated from said first shroud panel by a hinge line and adjacent said top face, a first lateral shroud panel separated from said first central shroud panel by a hinge line and disposed adjacent and facing one of said front or back stack faces and a second lateral shroud panel separated from said second central shroud panel by a hinge line and disposed adjacent and facing one of said front or back stack faces and medial to said first lateral shroud panel.

2. The combined shroud and stack of cases of claim 1 wherein said shroud further comprises a third lateral shroud panel separated from said first central shroud panel by a hinge line on a side opposite said first lateral shroud panel and disposed adjacent and facing one of said front or back stack faces.

3. The combined shroud and stack of cases of claim 2 wherein said shroud further comprises a fourth lateral shroud panel separated from said second central shroud panel by a hinge line and disposed adjacent one of said front or back stack faces and medial to said third lateral shroud panel on a side opposite said second lateral shroud panel.

4. The combined shroud and stack of cases of claim 3 wherein said hinge between said first and second central panels comprises a scoreline.

5. The combined shroud and stack of cases of claim 1 wherein the shroud is fabricated from corrugated fiberboard.

6. The combined shroud and stack of cases of claim 4 wherein the shroud is fabricated from corrugated fiberboard.

7. The combined shroud and stack of cases of claim 1 further comprising a second said one piece shroud and wherein said stack further comprises a second side face and said first central panel of said second shroud is disposed adjacent and facing said second side face and said second central panel of said second shroud is disposed adjacent and facing said top stack face.

8. The combined shroud and stack of cases of claim 5 further comprising a second said one piece shroud and wherein said stack further comprises a second side face and said first central panel of said second shroud is disposed adjacent and facing said second side face and said second central panel of said second shroud is disposed adjacent said top stack face.

9. The combined shroud and stack of cases of claim 5 wherein the first central shroud panel covers at least 50% of the area of the stack side face.

10. The combined shroud and stack of cases of claim 9 wherein the first central shroud panel covers at least 80% of the area of the stack side face.

11. The combined shroud and stack of cases of claim 9 wherein the second central panel of said shroud covers between 10 and 40% of the area of said top stack face.

12. The combined shroud and stack of cases of claim 11 wherein the second central panel of said shroud covers between 15 and 30% of the area of said top stack face.

13. The combined shroud and stack of cases of claim 11 further comprising a second shroud wherein the second central panel of said second shroud also covers between 10 and 40% of the area of said top stack face.

14. The combined shroud and stack of cases of claim 13 wherein each of the second central panels of said shrouds covers between 15 and 30% of the area of said top stack face.

15. The combined shroud and stack of cases of claim 9 wherein said first lateral panel of said shroud covers between 5 and 10% of the area of said front or back stack face.

16. The combined shroud and stack of cases of claim 9 further comprising a second said shroud wherein each of said first lateral panels of said shrouds covers between 5 and 10% of the area of said front or back stack faces.

17. The combined shroud and stack of cases of claim 9 wherein said second lateral panel of said shroud covers between 1 and 7% of the area of said front or back stack face.

18. The combined shroud and stack of cases of claim 9 further comprising a second said shroud wherein each of said second lateral panels of said shrouds covers between 1 and 7% of the area of said front or back stack faces.

19. The combined shroud and stack of cases of claim 1 further comprising a pallet or slip sheet, said stack resting on top of said pallet or slip sheet.

20. The combined shroud and stack of cases of claim 19 wherein said stack rests on the top of a pallet.

21. The combined shroud and stack of cases of claim 1 further comprising an "H" cut at least partially disposed within said second central shroud panel and a tab associated with said first lateral shroud panel, said tab being inserted into said "H" cut to lock said shroud.

* * * * *